United States Patent [19]

Roman

[11] Patent Number: 4,986,477

[45] Date of Patent: Jan. 22, 1991

[54] SPRAY GUN WITH ADJUSTMENT OF THE SHAPE OF THE JET

[75] Inventor: Gianfranco Roman, Pasiano, Italy

[73] Assignee: Claber S.p.A., Fiume Veneto, Italy

[21] Appl. No.: 391,408

[22] Filed: Aug. 8, 1989

Related U.S. Application Data

[63] Continuation of Ser. No. 172,087, Mar. 23, 1988, abandoned.

[30] Foreign Application Priority Data

Apr. 6, 1987 [IT] Italy ..... 21332/87[U]

[51] Int. Cl.[5] ..... B05B 1/04

[52] U.S. Cl. ..... 239/455; 239/525; 239/546

[58] Field of Search ..... 239/525, 526, 546, 533.13, 239/455, 592, 597

[56] References Cited

U.S. PATENT DOCUMENTS

| | | | |
|---|---|---|---|
| 177,239 | 5/1876 | Haley | 239/455 |
| 583,969 | 6/1897 | Askins | 239/455 |
| 2,303,992 | 12/1942 | Frazer et al. | 239/533.13 |
| 2,657,098 | 10/1953 | Strahman | 239/526 X |
| 2,937,813 | 5/1960 | Rinkewich | 239/526 X |
| 2,959,359 | 11/1960 | Casaletto | 239/455 |
| 3,776,470 | 12/1973 | Tsuchiya | 239/533.13 |
| 3,799,447 | 3/1974 | Beal | 239/526 X |
| 4,789,104 | 12/1988 | Anderson | 239/546 X |

FOREIGN PATENT DOCUMENTS

| | | | |
|---|---|---|---|
| 240951 | 2/1946 | Switzerland | 239/546 |

*Primary Examiner*—Andres Kashnikow
*Assistant Examiner*—Kevin Weldon
*Attorney, Agent, or Firm*—Eckert Seamans Cherin & Mellott

[57] ABSTRACT

A spray gun having a liquid delivery pipe provided with a nozzle openable by an axially movable control member which plugs an axial hole, has an adjustable diffusing member arranged downstream of the nozzle. The diffusing member has a pair of flexible parallel tangs integrally extending forward from the nozzle and a hollow sleeve arranged rotatably to incline the tangs at a selected angle, i.e., at a greater or lesser distance from one another than the diameter of the axial hole. The tangs each have a protruding tooth engaging in a spiral arc in the tightening sleeve collar, whereby rotation of the tightening sleeve collar moves the tangs toward or away from one another, up to extremities of the spiral arcs.

2 Claims, 2 Drawing Sheets

Fig.1
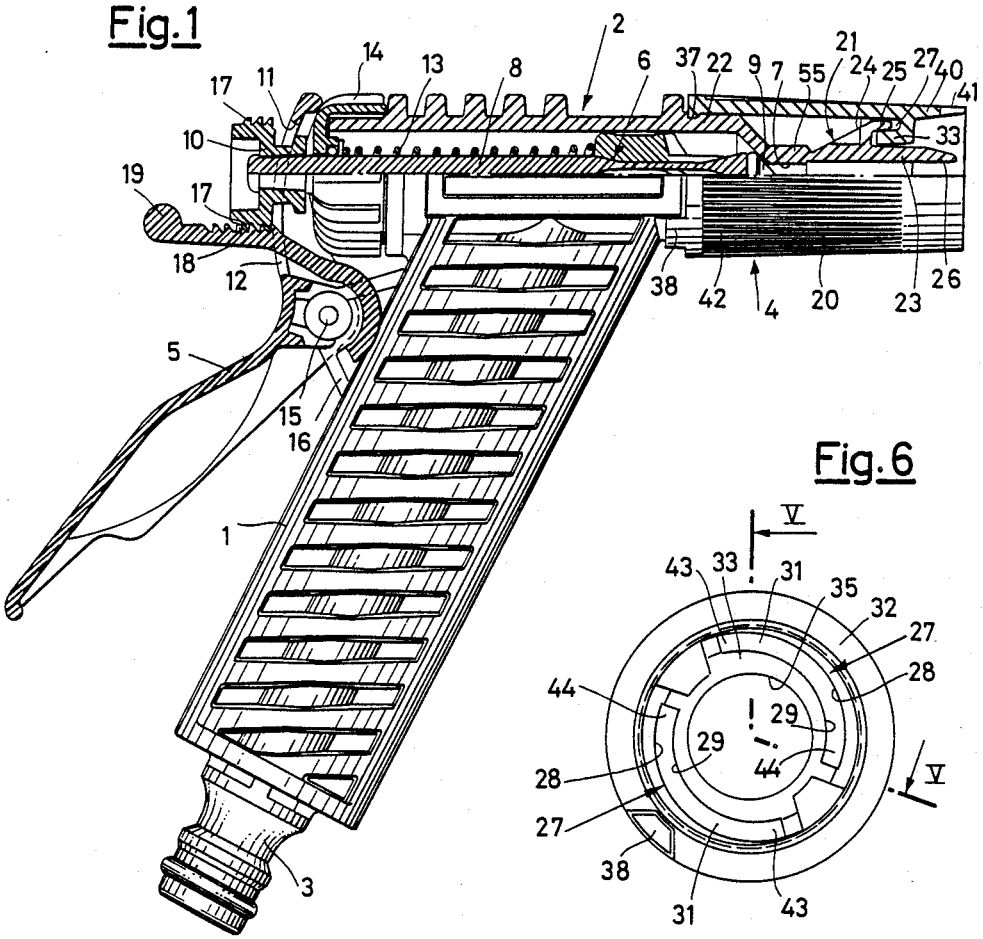
Fig.6
Fig.2
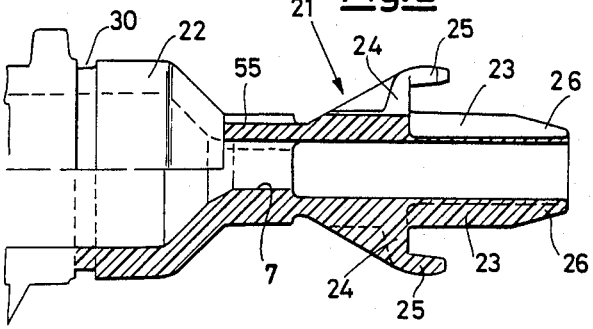
Fig.3
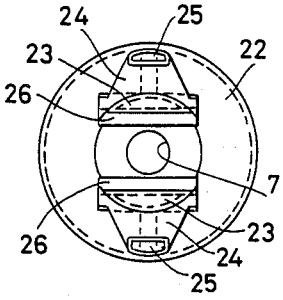

SPRAY GUN WITH ADJUSTMENT OF THE SHAPE OF THE JET

This is a continuation of application Ser. No. 172,087, filed Mar. 23, 1988, now abandoned.

DESCRIPTION

1. Field of the Invention

This invention refers to a spray gun with adjustment of the shape of the jet.

2. Prior Art

As is well known, spray guns are constituted by a delivery pipe connected to a hollow handgrip through which the liquid to be sprayed passes.

The delivery pipe terminates at its front end with a spray opening with a nozzle at its center through which the liquid is delivered.

Inside the delivery pipe there is a movable member for closing and opening the nozzle, said member being operated from the outside by means of appropriate control levers.

The adjustment of the flow of the liquid is obtained by operating the member for opening and closing the nozzle, namely, when the nozzle is open the delivered spray jet will have a limited diameter and range but with larger droplets; while when the nozzle is partially closed the delivered spray jet will have a larger diameter and range but with finely dispersed droplets.

The spray jet issuing from the nozzle has a circular shape and tends to concentrate on a larger or a smaller circular area in relation to the nozzle opening and to the distance between the surface to be sprayed and the gun.

With this type of spray gun it is not, however, possible to deliver flat-shaped spray jets with which it is possible to cover an area larger than with a circular spray jet.

Given this state of the art, the object of the present invention is to realize a spray gun which can vary the shape of the delivered spray jet, in particular so that it is possible to transform the spray jet, in adjustable way it as required, from a circular shape to a fan shape.

According to the invention, such object is attained by a spray gun which includes a delivery pipe connected to a hollow handgrip through which the liquid to be sprayed arrives, said pipe terminating at its front end with an opening provided with a nozzle which can be opened or closed for the delivery of the liquid contained in said pipe, characterized in that said opening includes an adjustable diffusing member arranged downstream from the nozzle in order to vary the conformation of the liquid jet issuing from said nozzle.

Said diffusing member preferably comprises two flat and parallel tangs or feathers, which can be moved closer or farther apart from one another by means of a tightening sleeve collar which engages the outer part of said tangs.

The tip of said tangs extends towards the outlet of the opening while the rear end is fastened to the wall of the delivery pipe with the nozzle.

BRIEF DESCRIPTION OF THE DRAWINGS

One possible embodiment of the present invention is illustrated as an example which is not restrictive in the enclosed drawings where:

FIG. 1 shows a partially sectioned side view of a spray gun according to the invention;

FIG. 2 shows a side view of a diffusing member, included in said gun, enlarged and partially sectioned;

FIGS. 3 and 4 are a right-hand view and a top view, respectively, of the diffusing member shown in FIG. 2;

FIG. 6 is a rear view of the above tightening sleeve collar;

Detailed Description of the Preferred Embodiments

Figure 4:
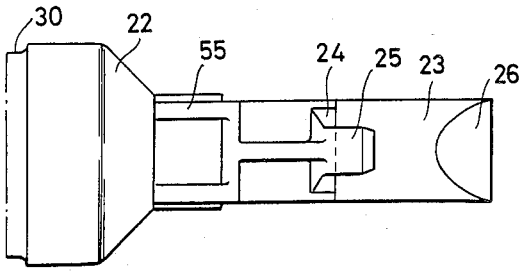

FIG. 1 shows a spray gun constituted by a hollow handgrip 1 connected to a delivery pipe 2.

At the base of the handgrip there is a coupling 3 for connecting a means (not shown) for feeding the liquid to be sprayed.

The delivery pipe 2 is equipped at one end with a spraying opening 4 and at the other end there is a trigger 5 which operates a closing and opening member 6 of a circular nozzle 7 arranged on the longitudinal axis of the front opening 4.

Said opening and closing member 6 is constituted by a rod 8 with, at one end, a plug 9 for the nozzle 7 and, at the other end, a tip 10 which engages said trigger 5.

The upper part of the latter has an opening 11, through which the rod 8 passes, said opening forming two lateral arms 12 which come together at the top, so that the tip 10 is pressed against said arms 12 by the action of a spring 13 contained in the delivery pipe 2. In turn, the arms 12 press against the rear end of the delivery pipe 2 which is closed by a ring nut 14.

The trigger 5 hinges on a pin 15 which is secured in a protrusion 16 of the handle 1. The tip 10 of the member 6 has lateral indentations 17 which engage with a complementary indentation 18 on a flexible portion 19 which passes through the trigger opening 11 and is secured at one end on said protrusion 16 around the pin 15.

The opening 4 at the front end of the delivery pipe 2 includes a tightening sleeve collar 20 which can rotate on a plastic diffusing member 21 integral with the casing 22 of the delivery pipe 2. Said casing 22 has a choke or neck 55 for the nozzle 7.

The diffusing member 21, as shown in FIGS. 2, 3 and 4, consists of two flexible tangs or feathers 23 which are cantilevered over the choke 55 of the pipe 2 and have side protrusions 24 from which the tapered teeth 25 extend towards the tips 26 of the tangs themselves.

The tightening sleeve collar 20 (FIG. 5) can rotate on said diffusing member 21 and for this object said collar has separate spiral arc seats 27 (FIG. 6) inside it which can receive the tapered teeth 25 of the diffusing member 21.

Said seats 27 have side walls 28 and 29 and a bottom 31 the external side walls 28 being defined by the casing 32 of the sleeve collar while the internal side walls 29 are defined by a flanged opening 33 contained within the sleeve collar, whose flange 34 is connected to the casing 32 of the sleeve collar and constitutes the bottom 31 of said seats 27.

Said opening defines a passage 35 for the tangs 23 of the diffusing member 21.

Each seat 27 is arranged along a spiral arc (FIG. 6) and has two extremities 43 and 44 of which a first extremity 43 is at a radial distance from the longitudinal axis of the passage 35 which is greater than the distance existing between said axis and the second extremity 44.

In addition the extremities 43 of each seat 27, in the same way as the extremities 44, are arranged in a diametrically opposite position, that is to say, the extremities 43 of the two seats 27 are aligned along the same line which passes through a diameter of the passage 35.

Figure 5:
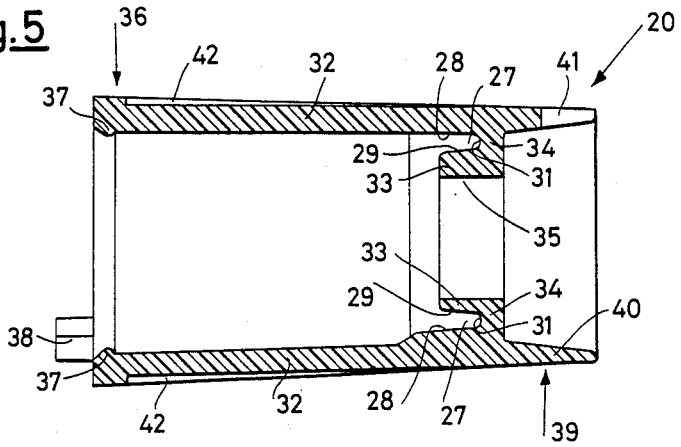
FIG. 5 shows a tightening sleeve collar included in the above gun, enlarged and sectioned along the line V—V in FIG. 6.

The rear end 36 of the sleeve collar 20, as shown in FIG. 5, has a ring-shaped protrusion 37 which penetrates in a circumferential groove 30 on the outside of the casing 22 of the delivery pipe 2 (FIGS. 2 and 4). From said rear end 36 a tooth 38, whose function will be described below, protrudes longitudinally.

The front end 39 of the sleeve collar 20 has a ring element 40 with a diverging internal wall at whose extremities there are notches 41 for the passage of the water when the opening is arranged for the delivery of a fan-shaped spray jet as will be described below.

The external surface of the casing 32 of the sleeve collar 20 has small longitudinal grooves 42 which are uniformly distributed and have a decreasing depth as they get closer to the sleeve collar's front end 39 so that it is easier to manipulate during the adjustment of the spray jet.

The spray gun described herein operates as follows.

Figure 7:
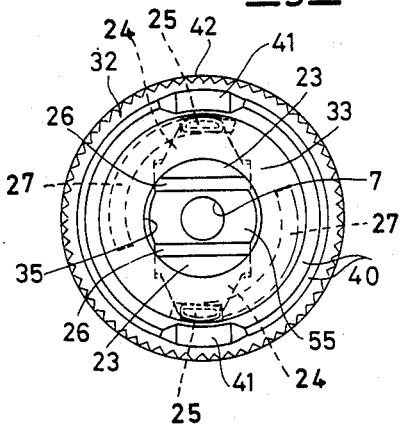
FIG. 7 shows an enlarged front view of the opening of said gun from the right-hand side in relation to FIG. 1 and in the position of delivery of a circular spray jet.

In the position shown in FIG. 1 the gun is at rest and the sleeve collar 20 is rotated to a position such that the teeth 25 of the diffusing member 21 are near the radially most external extremities 43 of the spiral seats 27 and thus keep the tangs 23 (FIG. 7) at a certain handgrip 1 and contained in the Water coming from the hollow handgrip 1 and contained in the delivery pipe 2 is not sprayed outside since the nozzle 7 is closed by the plug 9 of the opening and closing member 6 due to the action of the spring 13.

When the trigger 5 is pressed the arms 12 of the trigger 5 are made to move the tip 10 towards the outside against the action of the spring 13 while the indentation 17 is drawn along with the indentation 18 of the flexible part 19 and stops in the required position. At the same time the plug 9 moves backwards and releases the nozzle 7 and water will issue from the latter.

Since the nozzle is circular and the tangs 32 are at a certain distance from one another, the spray jet issuing from the opening 4 has a circular shape and passes, without being intercepted, in between the tangs 23 of the diffusing member 21 and thus takes an almost circular shape.

Figure 8:
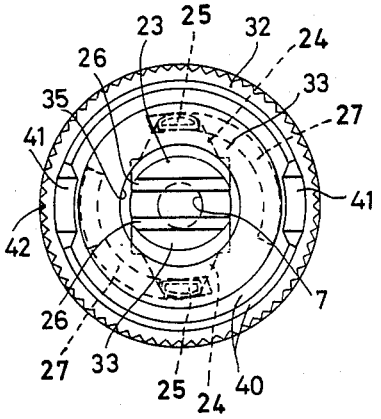
FIG. 8 shows an enlarged front view of said opening in the position of delivery of a flat spray jet.

If a flattened, fan-shaped spray jet is required it is only necessary to rotate the sleeve collar 20 so that the teeth 25 of the diffusing member 21, as they move along their seats 27, reach the extremities 44 of the seats 27 while getting closer to the axis 35 of the passage and press the tangs 23 of said diffusing member 21 towards the sides, which thus move closer together (FIG. 8). The tangs 23 will, in this way, be in the path of the jet which is thus intercepted and flattened. In this position the notches 41 inside the ring portion 40 of the sleeve collar 20 are arranged alongside the slot defined by the tangs 23, so that an optimum lateral widening of the issuing spray jet is obtained.

In addition, the tooth 38 in the rear part of the sleeve collar 20 has, when the sleeve itself is rotated, gone through an arc of a circle and is now on the opposite side of the gun, thus signalling that the opening 4 is ready for a fan-shaped spray jet.

When the circular spray jet is once more required the sleeve collar 20 is rotated in the opposite direction, thus moving the tangs 23 away from one another since the teeth 25 of the diffusing member 21 move along the seats 27 and reach their extremities 43.

It is obviously possible to adjust the spray jet, that is the reciprocal movement of the tangs 23, by partially rotating the sleeve collar 20 so that the teeth 25 move only part of the way along their seats 27.

I claim:

1. A spray gun, comprising:

a liquid delivery pipe provided with a nozzle passed through by a circular axial hole along the delivery pipe;

a control rod axially movable in said delivery pipe for opening and closing said axial hole of the nozzle; and, an adjustable diffusing member arranged downstream of said nozzle, said diffusing member including a pair of flexible, substantially flat shaped, parallel tangs integrally extending forwards form said nozzle in a cantilever fashion and a hollow sleeve rotatably arranged around said tangs, said tangs having lateral protrusions provided with forwardly-extending teeth and said sleeve being provided with spiral arc seats engaged by said pins such that rotation of said sleeve causes said tangs to move radially between a first position at which said tangs are spaced by a distance greater than a diameter of the axial hole of the nozzle, whereupon said axial hole is unobstructed for causing a liquid jet of circular shape, and a second position, in which said tangs are spaced at a distance less than the diameter of the axial hole, so as to obstruct said hole partially, causing the spray gun to emit a liquid jet of rectangular shape.

2. The spray gun according to claim 1, wherein said sleeve has a forward end provided with diametrically-opposite notches for accommodating the liquid jet.

* * * * *

UNITED STATES PATENT AND TRADEMARK OFFICE

CERTIFICATE OF CORRECTION

PATENT NO. : 4,986,477

DATED : January 22, 1991

INVENTOR(S) : ROMAN

It is certified that error appears in the above-identified patent and that said Letters Patent is hereby corrected as shown below:

Column 3, line 33, replace "handgrip 1 and contained in the" with --distance from one another--.

Signed and Sealed this

Eighth Day of September, 1992

*Attest:*

DOUGLAS B. COMER

*Attesting Officer*

*Acting Commissioner of Patents and Trademarks*